US010588393B2

(12) United States Patent
Lee

(10) Patent No.: US 10,588,393 B2
(45) Date of Patent: Mar. 17, 2020

(54) COSMETIC CONTAINER INCORPORATING ROD-SHAPED COSMETIC CONTAINER

(71) Applicant: PUM-TECH KOREA CO., LTD., Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 373 days.

(21) Appl. No.: 15/121,741

(22) PCT Filed: Mar. 4, 2015

(86) PCT No.: PCT/KR2015/002106
§ 371 (c)(1),
(2) Date: Aug. 25, 2016

(87) PCT Pub. No.: WO2015/133826
PCT Pub. Date: Sep. 11, 2015

(65) Prior Publication Data

US 2017/0119129 A1 May 4, 2017

(30) Foreign Application Priority Data

Mar. 5, 2014 (KR) ..... 10-2014-0026272

(51) Int. Cl.
*A45D 33/28* (2006.01)
*A45D 40/22* (2006.01)
(Continued)

(52) U.S. Cl.
CPC ..... *A45D 33/28* (2013.01); *A45D 33/008* (2013.01); *A45D 40/221* (2013.01);
(Continued)

(58) Field of Classification Search
CPC ..... A45D 2033/001; A45D 2040/0025; A45D 2040/224; A45D 2040/225; A45D 33/006;
(Continued)

(56) References Cited

U.S. PATENT DOCUMENTS 1,632,864 A * 6/1927 Weber ..... A45D 33/28 132/294
2,512,476 A * 6/1950 Birnkrant ..... A45D 40/02 132/316
(Continued)

FOREIGN PATENT DOCUMENTS

FR 2814649 A1 * 4/2002 ..... A45D 33/28
JP 05-039413 U 5/1993
(Continued)

*Primary Examiner* — Fenn C Mathew
*Assistant Examiner* — Madison L Poos
(74) *Attorney, Agent, or Firm* — Heedong Chae; Lucem, PC

(57) ABSTRACT

The present invention relates to a compact container incorporating a rod-shaped cosmetic container and, more particularly, to a compact container incorporating a rod-shaped cosmetic container, the compact container having a rod-shaped cosmetic container incorporated in a hinge portion thereof to be stored/used such that the compact container and the rod-shaped cosmetic container can be carried and used together. In addition, the present invention relates to a compact container incorporating a rod-shaped cosmetic container, the compact container having a rod-shaped cosmetic container operating member formed therein such that, when the compact container cap is opened, the rod-shaped cosmetic container moves out of the hinge portion of the compact container and, when the compact container cap is closed, the rod-shaped cosmetic container moves into the hinge portion of the compact container, thereby ensuring that the rod-shaped cosmetic container automatically pro-
(Continued)

tracts from the compact container or retracts thereto as the compact container is opened/closed.

8 Claims, 11 Drawing Sheets

(51) Int. Cl.
*A45D 40/24* (2006.01)
*A45D 33/00* (2006.01)
*B65D 43/16* (2006.01)

(52) U.S. Cl.
CPC ..... *A45D 40/222* (2013.01); *A45D 40/24* (2013.01); *B65D 43/164* (2013.01); *A45D 2040/224* (2013.01); *A45D 2040/225* (2013.01)

(58) Field of Classification Search
CPC ..... A45D 33/008; A45D 33/26; A45D 33/28; A45D 40/0075; A45D 40/02; A45D 40/06; A45D 40/065; A45D 40/18; A45D 40/221; A45D 40/222; A45D 40/24; B65D 43/164; A45C 11/24; A45C 13/005; A45C 2001/067
USPC ..... 132/294, 297, 295; 220/845
See application file for complete search history.

(56) References Cited

U.S. PATENT DOCUMENTS

| | | | | |
|---|---|---|---|---|
| 7,380,655 | B1 * | 6/2008 | Thune | A45C 1/06 206/214 |
| 2014/0231304 | A1 * | 8/2014 | Lee | A45D 33/006 206/581 |

FOREIGN PATENT DOCUMENTS

| | | | |
|---|---|---|---|
| JP | 2000-128203 | A | 5/2000 |
| KR | 20-2012-0004871 | U | 7/2012 |
| KR | 20-0469710 | Y1 | 11/2013 |

* cited by examiner

-- PRIOR ART --

-- PRIOR ART --

COSMETIC CONTAINER INCORPORATING ROD-SHAPED COSMETIC CONTAINER

TECHNICAL FIELD

The present invention relates to a compact container having a rod-shaped cosmetic container provided therein and, more particularly, to a compact container having a rod-shaped cosmetic container provided therein, in which the compact container is provided in a hinge portion thereof with a rod-shaped cosmetic container to be stored/used so that the compact container and the rod-shaped cosmetic container can be carried and used together.

In addition, the present invention relates to a compact container having a rod-shaped cosmetic container provided therein, in which the compact container is formed in an inner part thereof with an actuation member of the rod-shaped cosmetic container such that, when the compact container cap is open, the rod-shaped cosmetic container is withdrawn out of a hinge portion of the compact container and, when the compact container cap is closed, the rod-shaped cosmetic container is introduced into the hinge portion of the compact container, thereby ensuring that the rod-shaped cosmetic container automatically protrudes out of the compact container or is received into the compact container as the compact container is open/closed.

BACKGROUND ART

In general, women make up express their faces beautiful and gorgeous. Makeups are mainly classified into base makeup, color makeup, hair makeup, and body makeup. Among them, the color makeup aims at making a face, which is more gorgeous, after the basic makeup, and is performed by taking beauty, color, and trend into consideration.

Color makeups are classified into skin makeups using a makeup base, a foundation, and powers, eye makeups using an eye shadow, an eye liner, an eye brow, and a mascara, lip makeups using a lipstick, a lip gloss, and a lip cream, and blusher makeups for color makeup of a cheek and a chin.

Among the color makeups, a compact and a lipstick are representative products used in connection with each other. Most of women carry and frequently use compacts and lipsticks in their handbags.

However, although the compact and the lipstick are used together in face makeup, a user must separately carry the compact and the lipstick, so that the user may feel inconvenient when using them. Especially, when the user carries the compact and the lipstick in a handbag, they are mixed with the other articles so that the user must inconveniently look for the compact or the lipstick.

In order to solve the problem, as shown in FIG. 1, a compact container having the combination of a compact and a lipstick is disclosed in Korean Utility Model 20-0445594. The related art provides a compact container which stores makeups used in connection with each other by combining them with each other and allows the makeups to be carried together.

According to the related art, there are provided a compact container 1, a lipstick container 2 formed at one side of the compact container 1, guide rails 5 provided on both sidewalls of a coupling part 6 of the compact container 1 and having an inclination part 3 and a linear part 4, and coupling units 9 provided on both sidewalls of the lipstick container 2 and including a locking groove 7 and a locking step 8, so that the lipstick container 2 is detachably coupled to the coupling part according to the guidance of the guide rail 5.

However, according to the related art, since the lipstick container 2 is simply locked to an outer portion of the compact container 1, when a user carries the compact container 1 in a handbag, the lipstick container 2 may be easily separated from the compact container 1 due to external shock.

In order to solve the above problem, as shown in FIG. 2, a compact container provided therein with a lipstick is disclosed in Japanese Unexamined Patent Publication No. 1996-38246. According to the related art, the lipstick is provided in a hinge portion of the compact container to prevent the lipstick from being easily separated from the compact container. There are provided a lipstick 200 and a compact container 201 having a cylindrical receiving member 202 to receive the lipstick 200.

However, according to the related art, as the compact container 201 is open or closed, the lipstick 200 is not automatically withdrawn out of the compact container 201 or introduced into the compact container 201. Accordingly, after a user personally pulls the lipstick 200 out of the compact container 201 and uses the lipstick 200, the user must insert the lipstick 200 into the compact container 201.

DISCLOSURE

Technical Problem

The present invention is made in order to solve the problems occurring the related arts, and an object of the present invention is to provide a compact container having a rod-shaped cosmetic container provided therein, in which the compact container is provided in a hinge portion thereof with the rod-shaped cosmetic container to be stored/used so that the compact container and the rod-shaped cosmetic container can be carried and used together.

In addition, another object of the present invention is to provide a compact container having a rod-shaped cosmetic container provided therein, in which the compact container is formed in an inner part thereof with an actuation member of the rod-shaped cosmetic container such that, when the compact container cap is open, the rod-shaped cosmetic container is withdrawn out of a hinge portion of the compact container and, when the compact container cap is closed, the rod-shaped cosmetic container is introduced into the hinge portion of the compact container, thereby ensuring that the rod-shaped cosmetic container automatically protrudes out of the compact container or is received into the compact container as the compact container is open/closed.

Technical Solution

The present invention provides a compact container having a compact container body hinged with a compact container cap, and a rod-shaped cosmetic container provided therein. The compact container includes: the compact container body (10) receiving a content container (50) inserted into an inner central portion thereof and formed at a hinge side thereof with a first cylindrical hinge (11) and a second cylindrical hinge (12);

the compact container cap (20) hinged with an upper portion of the compact container body (10) and having a cap cylindrical hinge (21);

a rotation cylindrical hinge (30) inserted into the first cylindrical hinge (11) and the cap cylindrical hinge (21) to hinge the compact container cap (20) with the compact container body (10);

an actuation member (40) inserted into the second cylindrical hinge (12) and an end portion of the rotation cylindrical hinge (30); and the rod-shaped cosmetic container (60) inserted into the rotation cylindrical hinge (30) and the actuation member (40).

The first cylindrical hinge (11) and the second cylindrical hinge (12) of the compact container body (10) have hollow cylindrical shapes, and the second cylindrical hinge (12) is formed in an inner side thereof with a linear recess (121) into which the first protrusion (41) of the actuation member (40) is fitted to slide.

The cap cylindrical hinge (21) of the compact container cap (20) has a hollow cylindrical shape, a fitting protrusion (211) protrudes from one side of an inner part of the cap cylindrical hinge (21), and a mounting annular groove (212) is formed in an opposite side of the inner part of the cap cylindrical hinge (21).

The rotation cylindrical hinge (30) is formed at one side thereof with the fitting slit (31), a rotation slit (32), and a coupling protrusion (33), and at an opposite side thereof with an elastic member (34) having an elastic protrusion (341).

The actuation member (40) is formed on an outer side thereof with the first protrusion (41) fitted into the linear recess (121) of the second cylindrical hinge (12) of the compact container body (10) and the second protrusion (42) fitted into the rotation slit (32) of the rotation cylindrical hinge (30).

In addition, according to the present invention, after the content container (50) is inserted into the inner central portion of the compact container body (10), and a compact intermediate cover (54) is coupled to an upper portion of the compact container body (10). The content container (50) includes an outer wall (501) and an inner wall (502), the fixing member (53) is fitted into the outer and inner walls (501) and (502), and the content container cap (51) is coupled to the upper portion of the content container (50) by a hinge pin (52).

In addition, a puff space (511) is formed in an upper portion of the content container cap (51).

Advantageous Effects

As described above, according to the compact container having the rod-shaped cosmetic container provided therein of the present invention, the compact container is provided in the hinge portion thereof with the rod-shaped cosmetic container to be stored/used so that the compact container and the rod-shaped cosmetic container can be carried and used together.

According to the compact container having the rod-shaped cosmetic container provided therein of the present invention, the compact container is formed in the inner part thereof with the actuation member of the rod-shaped cosmetic container such that, when the compact container cap is open, the rod-shaped cosmetic container is withdrawn out of a hinge portion of the compact container and, when the compact container cap is closed, the rod-shaped cosmetic container is introduced into the hinge portion of the compact container, thereby ensuring that the rod-shaped cosmetic container automatically protrudes out of the compact container or is received into the compact container as the compact container is open/closed.

BEST MODE

Mode for Invention

Hereinafter, a compact container having a rod-shaped cosmetic container provided therein according to one embodiment of the present invention will be described with reference to accompanying drawings.

Figure 1:
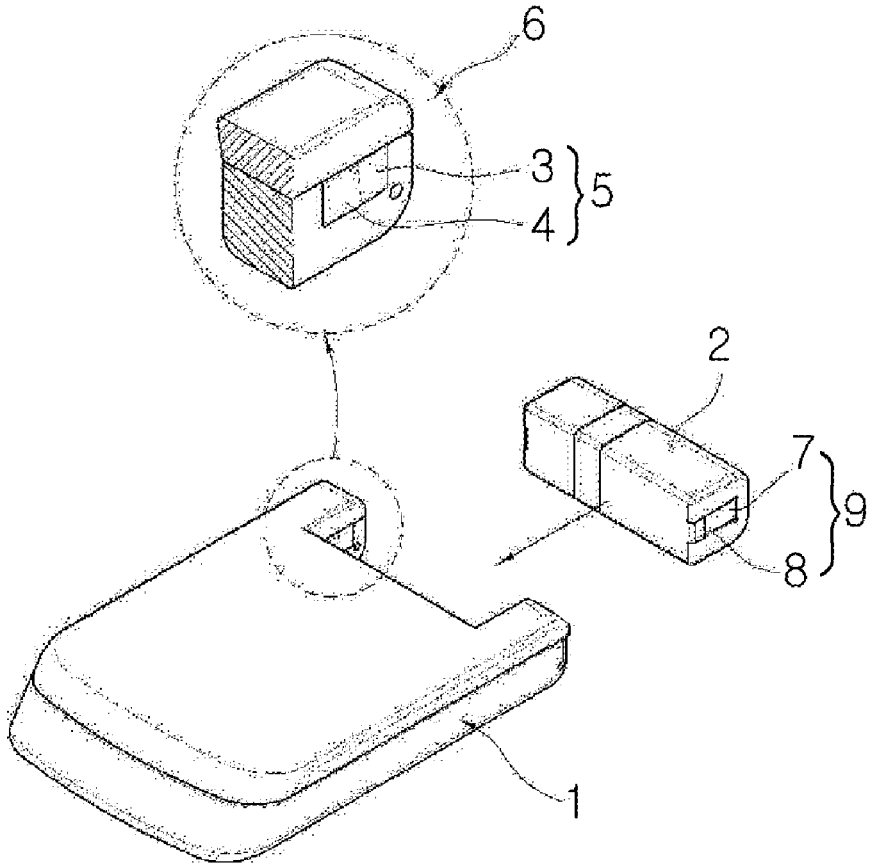
FIG. 1 is a perspective view showing a compact container having a lipstick coupled thereto according to the present invention.
Figure 2:
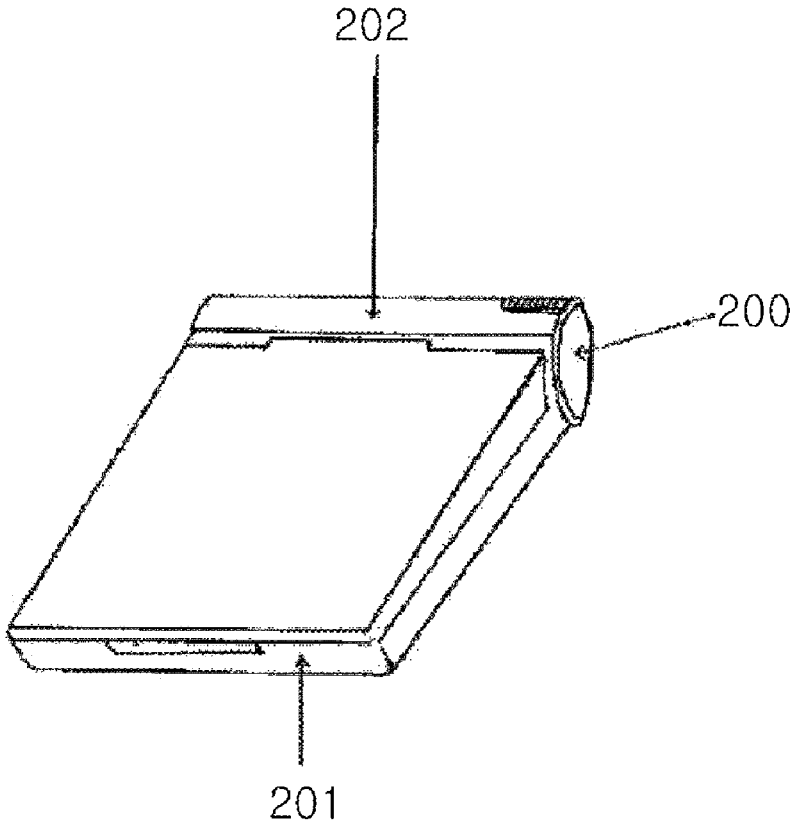
FIG. 2 is a perspective view showing a compact container having another lipstick provided therein according to the present invention.
Figure 3:
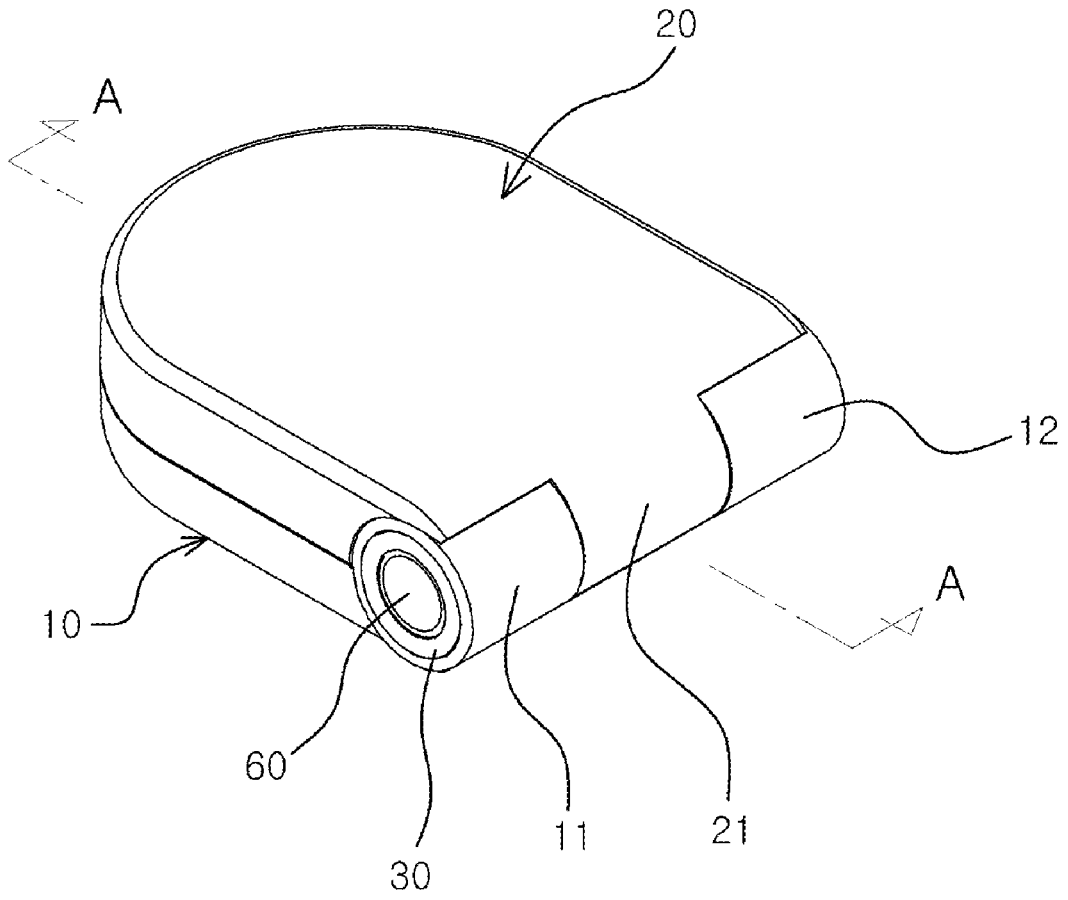
FIG. 3 is a perspective view showing a compact container having a rod-shaped cosmetic container provided therein according to one embodiment of the present invention.
Figure 4:
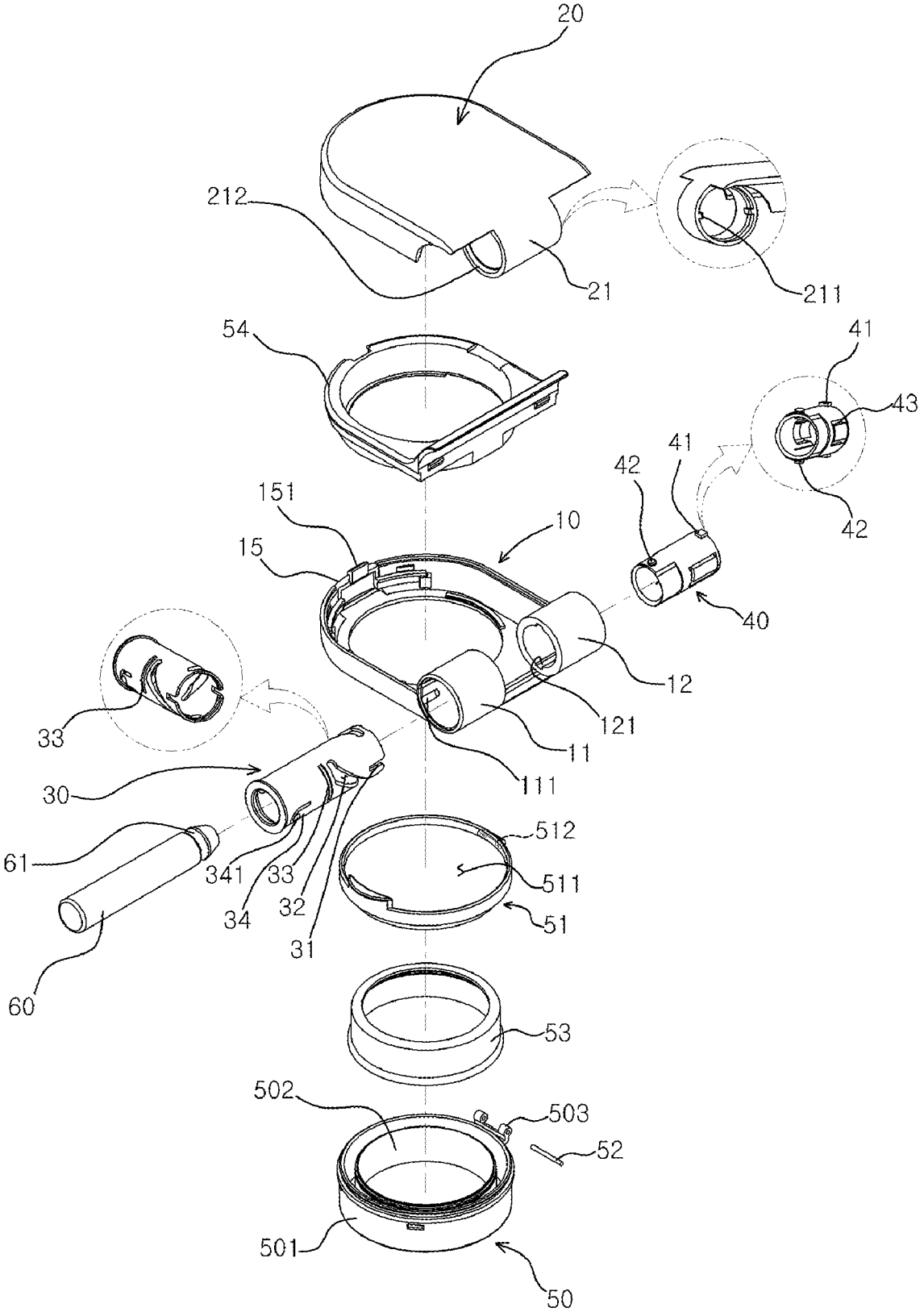
FIG. 4 is an exploded perspective view showing the compact container having the rod-shaped cosmetic container provided therein according to one embodiment.
Figure 5:
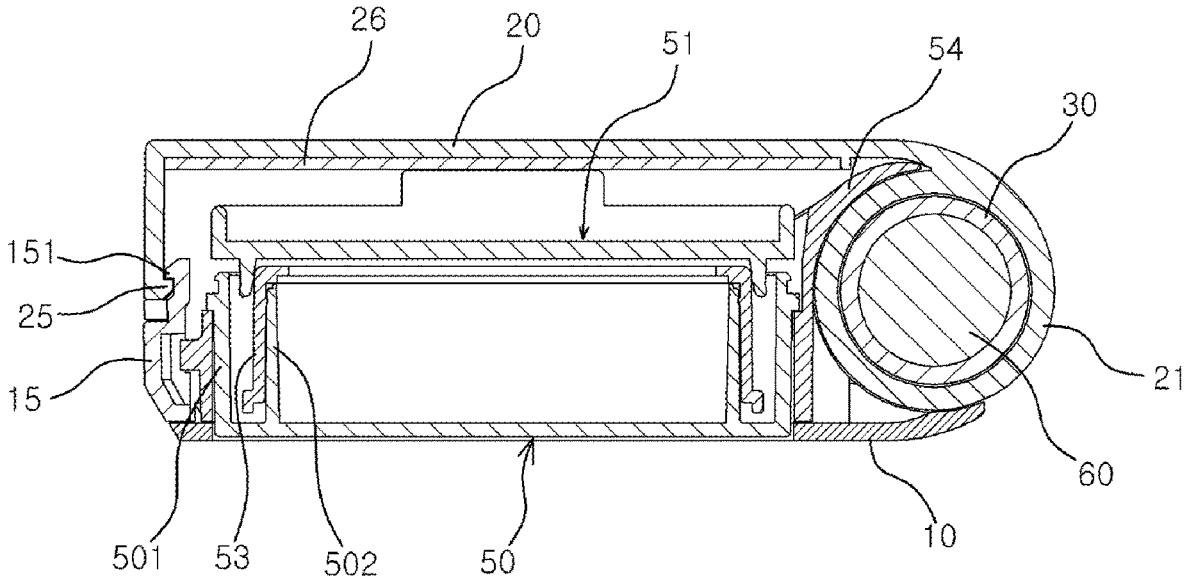
FIG. 5 is a sectional view taken along line A-A of FIG. 3.
Figure 6:
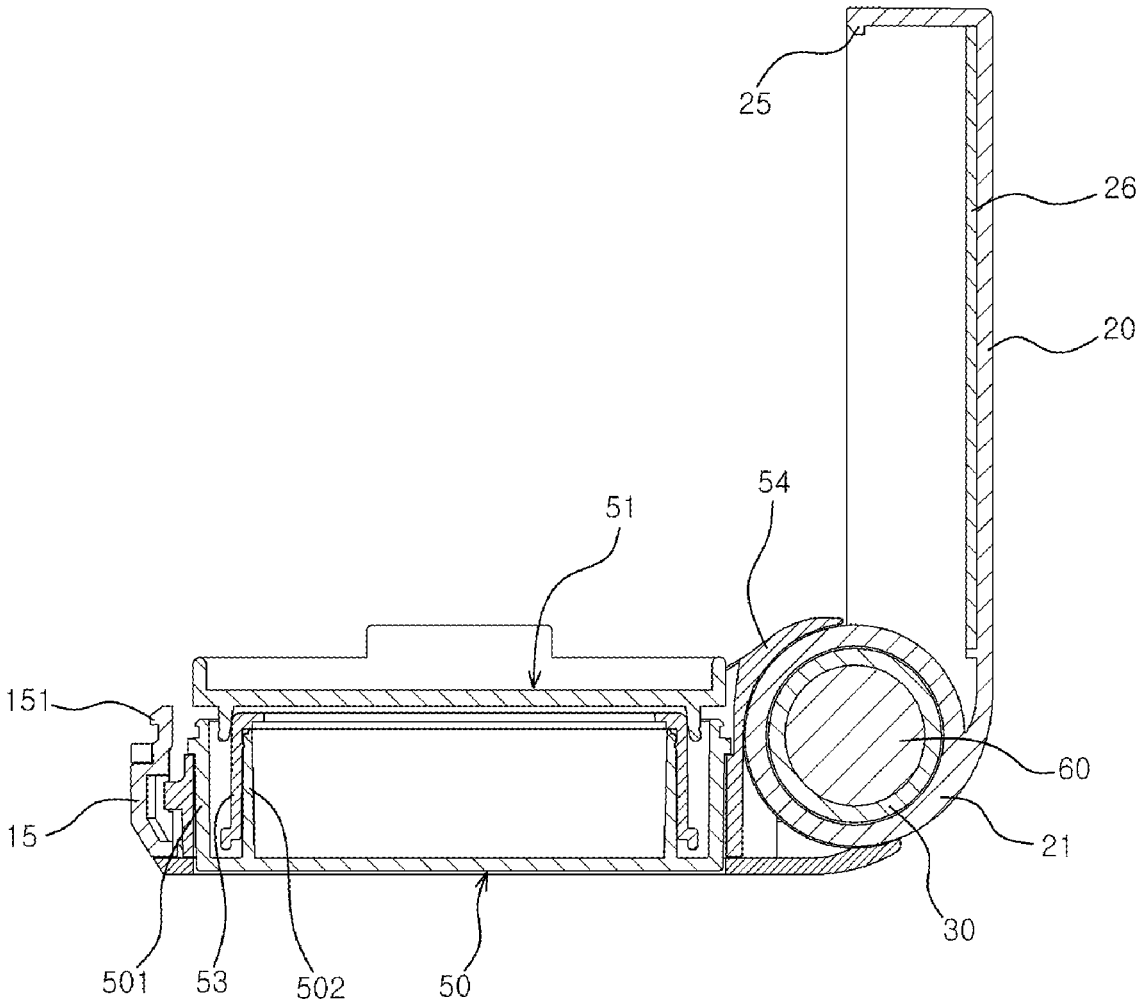
FIG. 6 is a sectional view showing that the compact container cap is open in FIG. 5.
Figure 7:
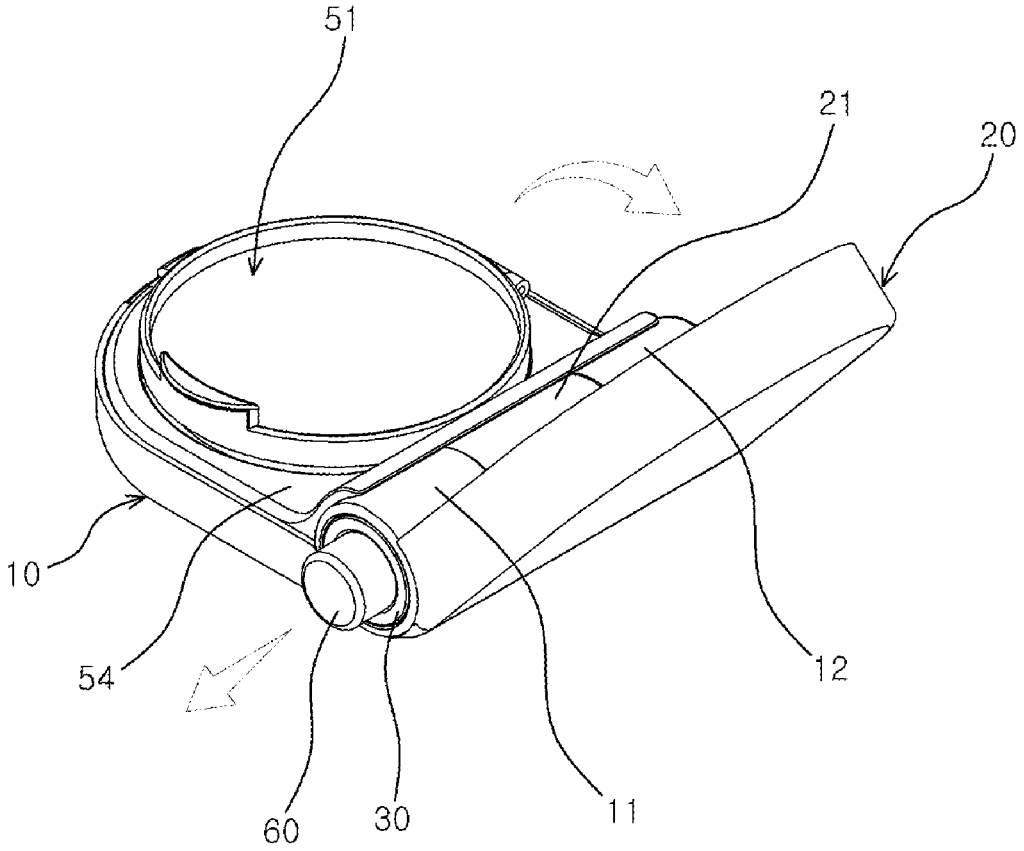
FIG. 7 is a perspective view showing the withdrawal of the rod-shaped cosmetic container when the compact container cap of the compact container is coupled to the rod-shaped cosmetic container is open.
Figure 8:
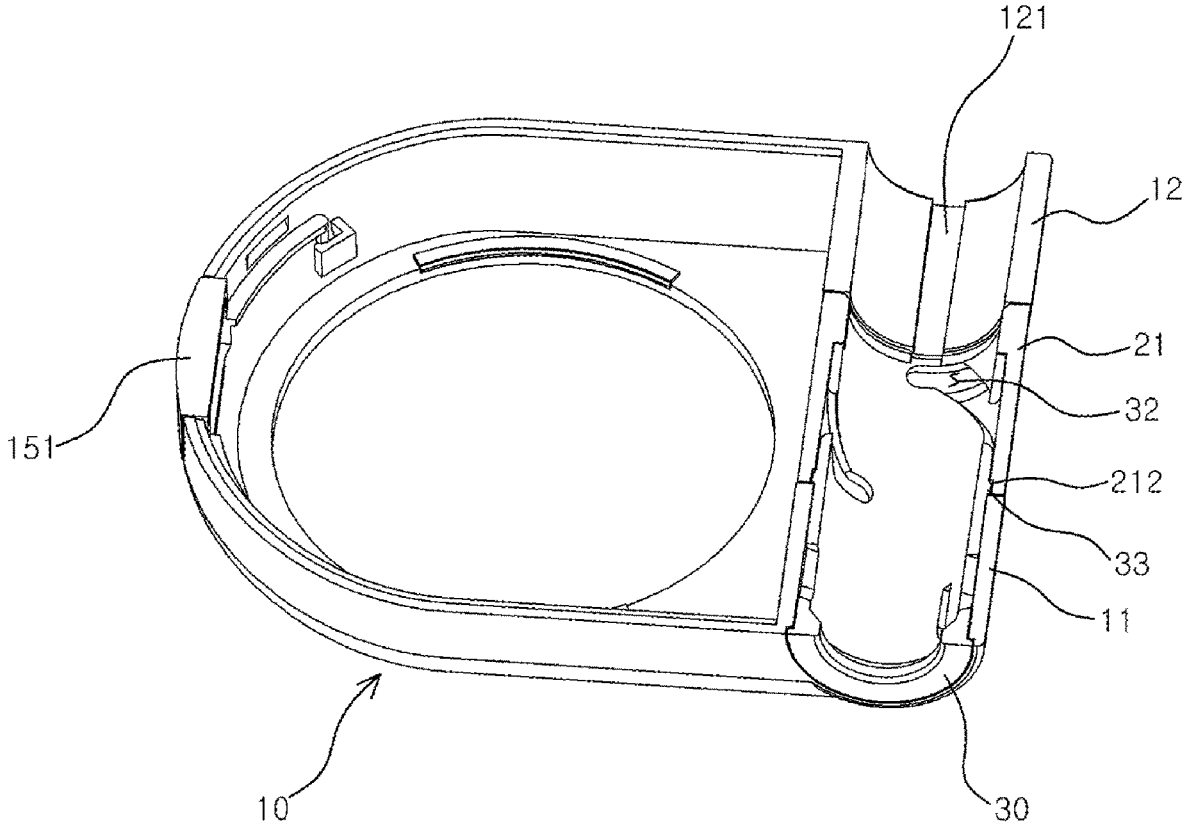
FIG. 8 is a partially cut perspective view showing that a rotation cylindrical hinge is coupled to a compact container body of the compact container coupled to the rod-shaped cosmetic container according to one embodiment of the present invention.
Figure 9:
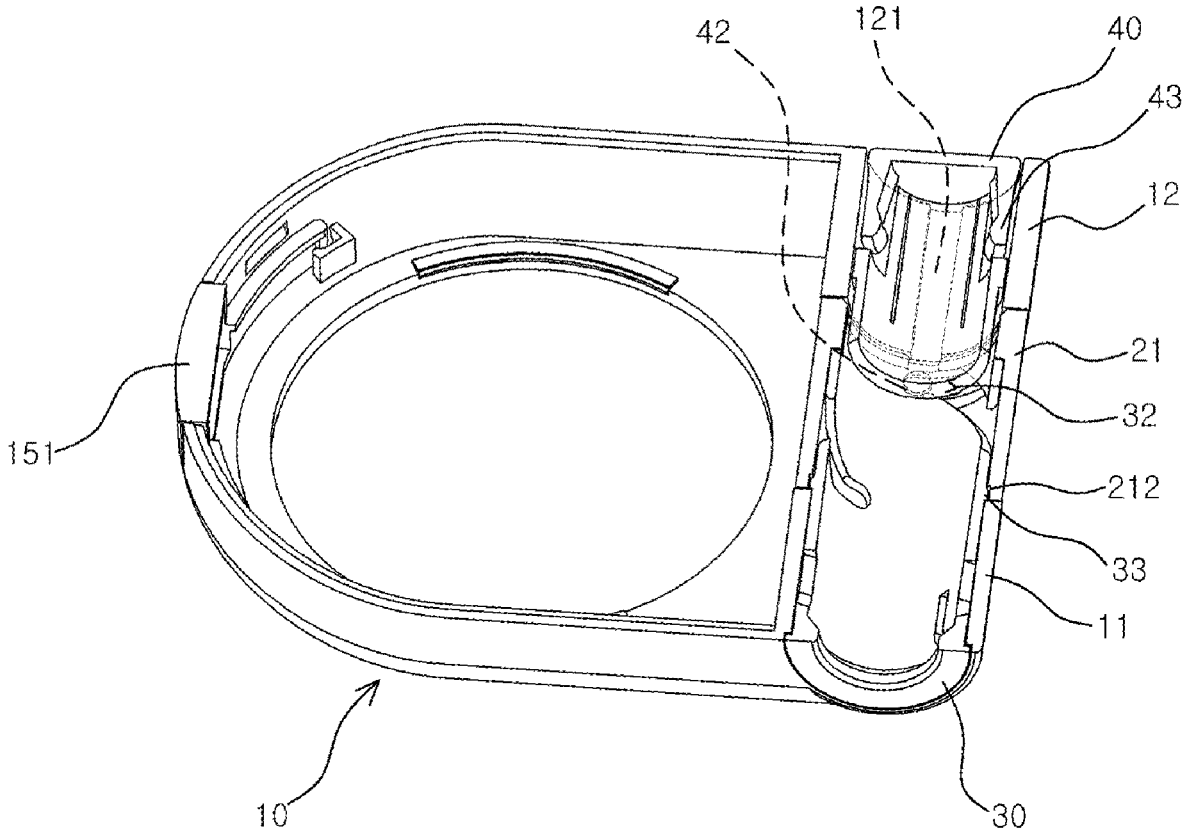
FIG. 9 is a partially cut perspective view showing that an actuation member is coupled in the state of FIG. 8.
Figure 10:
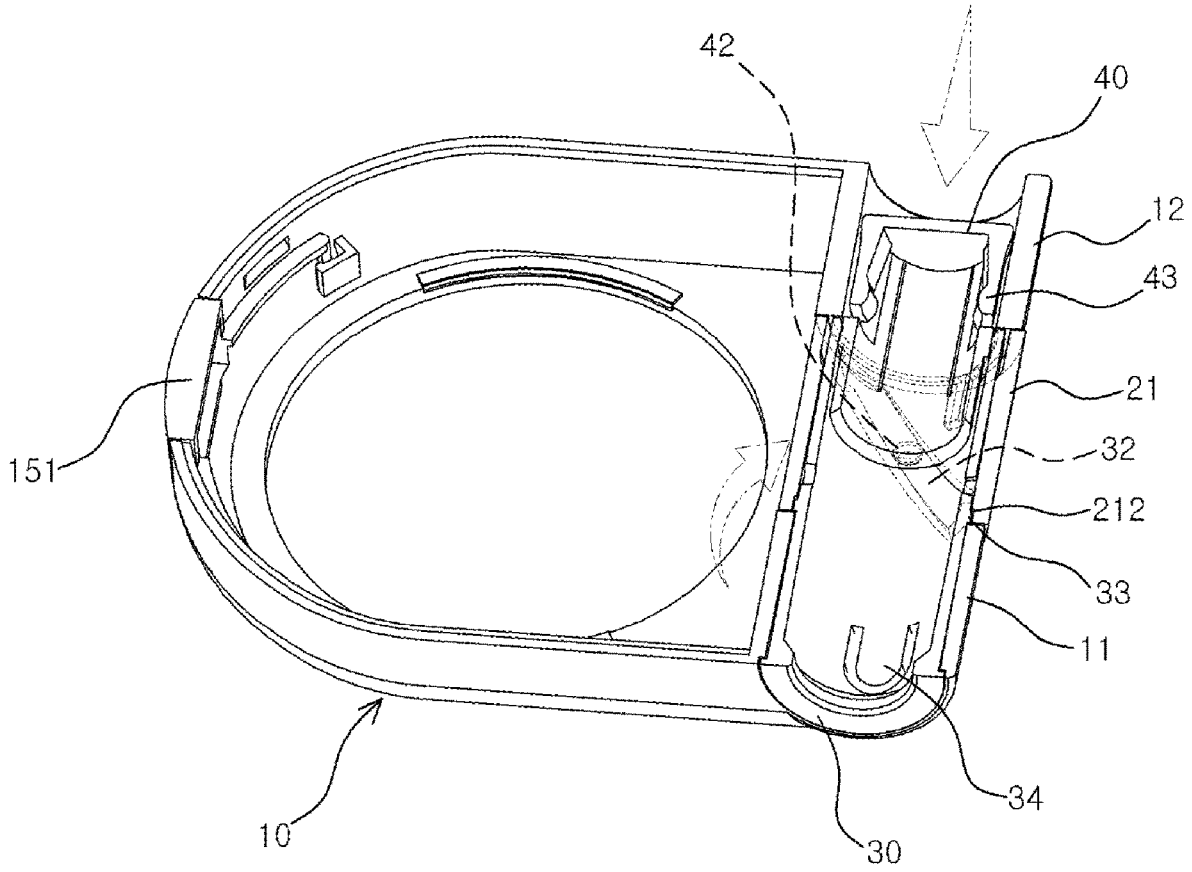
FIGS. 10 and 11 are partially cut perspective views showing the operation state of the actuation member when the rotation cylindrical hinge is rotated in FIG. 9.
Figure 11:
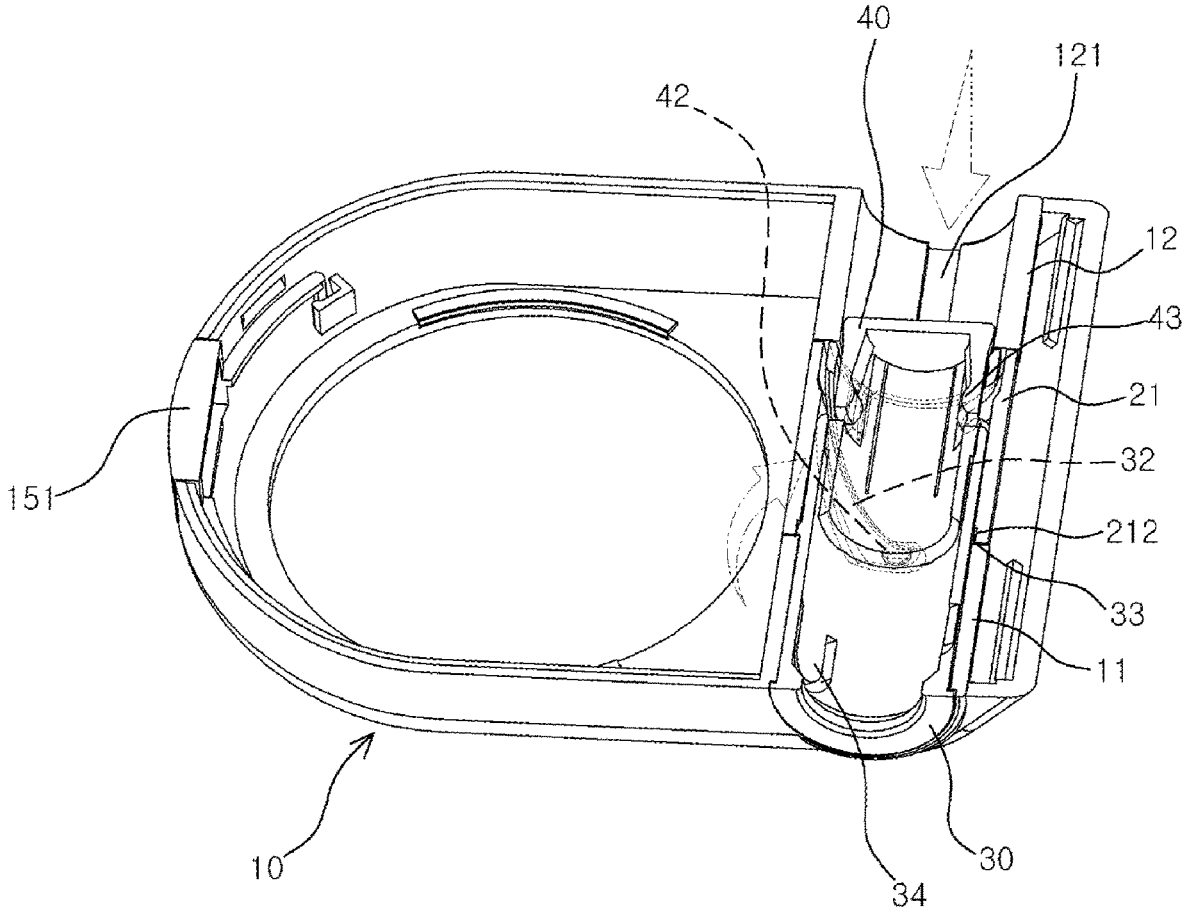

FIG. 3 is a perspective view showing a compact container having a rod-shaped cosmetic container provided therein according to one embodiment of the present invention. FIG. 4 is an exploded perspective view showing the compact container having a rod-shaped cosmetic container provided therein according to one embodiment. FIG. 5 is a sectional view taken along line A-A of FIG. 3. FIG. 6 is a sectional view showing that the compact container cap is open in FIG. 5. FIG. 7 is a perspective view showing the withdrawal of the rod-shaped cosmetic container when the compact container cap of the compact container is coupled to the rod-shaped cosmetic container is open. FIG. 8 is a partially cut perspective view showing that a rotation cylindrical hinge is coupled to a compact container body of the compact container coupled to the rod-shaped cosmetic container according to one embodiment of the present invention. FIG. 9 is a partially cut perspective view showing that an actuation member is coupled in the state of FIG. 8. FIGS. 10 and 11 are partially cut perspective views showing the operation state of the actuation member when the rotation cylindrical hinge is rotated in FIG. 9.

According to the present invention, a compact container including a compact container body hinged with a compact container cap and having a rod-shaped cosmetic container provided therein includes a compact container body 10 which receives a content container 50 inserted into an inner central portion thereof and is formed at a hinge side thereof with a first cylindrical hinge 11 and a second cylindrical hinge 12, a compact container cap 20 hinged with an upper portion of the compact container body 10 and having a cap cylindrical hinge 21, a rotation cylindrical hinge 30 inserted into the cap cylindrical hinge 21 and the first cylindrical hinge 11 to hinge the compact container cap 20 with the compact container body 10, an actuation member 40 inserted into the second cylindrical hinge 12 and an end portion of the rotation cylindrical hinge 30 to hinge the compact container cap 20 with the compact container body 10, and a rod-shaped cosmetic container 60 inserted into the rotation cylindrical hinge 30 and the actuation member 40.

The compact container body 10 includes the first cylindrical hinge 11 and the second cylindrical hinge 12.

The first cylindrical hinge 11 and the second cylindrical hinge 12 have hollow cylindrical shapes, and the second cylindrical hinge 12 is formed in an inner side thereof with a linear recess 121 into which the first protrusion 41 of the actuation member 40 is fitted to slide.

The cap cylindrical hinge 21 of the compact container cap 20 has a hollow cylindrical shape, a fitting protrusion 211 protrudes from one side of an inner part of the cap cylindrical hinge 21, and a mounting annular groove 212 is formed in an opposite side of the inner part of the cap cylindrical hinge 21.

The fitting protrusion 211 is fitted into a fitting slit 31 of the rotation cylindrical hinge 30.

As shown in FIG. 8, a coupling protrusion 33 of the rotation cylindrical hinge 30 is coupled to the mounting annular groove 212.

The rotation cylindrical hinge 30 is formed at one side thereof with the fitting slit 31, a rotation slit 32, and a coupling protrusion 33, and at an opposite side thereof with an elastic member 34 having an elastic protrusion 341.

The fitting protrusion 211 formed on the cap cylindrical hinge 21 of the compact container cap 20 is fitted into the fitting slit 31 so that the rotation cylindrical hinge 30 is rotated together when the compact container cap 20 is open and closed.

A second protrusion 42 of the actuating member 40 is fitted into the rotation slit 32 so that the actuation member 40 is linearly moved when the rotation cylindrical hinge 30 is rotated.

The coupling protrusion 33 is formed on an outer circumferential surface of the rotation cylindrical hinge 30, and coupled to the mounting annular groove 212 formed in the cap cylindrical hinge 21 of the compact container cap 20 to prevent the rotation cylindrical hinge 30 from the compact container body 10 as shown in FIG. 8.

The elastic member 34 is formed on one side thereof with an elastic protrusion 341, and the elastic protrusion 341 makes a close contact to an inner circumferential surface of the first cylindrical hinge 11 when the rotation cylindrical hinge 30 is inserted into the first cylindrical hinge 11 to prevent the rotation cylindrical hinge 30 from being loosely rotated in the first cylindrical hinge 11, so that a rotation feeling may be smoothly maintained in the opening/closing operation of the compact container cap 20 coupled to the rotation cylindrical hinge 30.

The actuation member 40 is formed on an outer side thereof with a first protrusion 41 fitted into the linear recess 121 of the second cylindrical hinge 12 of the compact container body 10 and a second protrusion 42 fitted into the rotation slit 32 of the rotation cylindrical hinge 30, and formed on an inner side thereof with a coupling protrusion 43. The coupling protrusion 43 may be clearly shown in FIG. 9.

The first protrusion 41 is fitted into the linear recess 121 of the second cylindrical hinge 12 to linearly slide the actuation member 40.

The second protrusion 42 is fitted into the rotation slit 32 of the rotation cylindrical hinge 30 to linearly move the actuation member 40 as shown in FIGS. 10 and 11 when the rotation cylindrical hinge 30 is rotated.

The coupling protrusion 43 is formed on an inner side of a cut portion formed in an outer circumferential surface of the actuation member 40 and coupled to a coupling groove 61 formed in the rod-shaped cosmetic container 60 when the rod-shaped cosmetic container 60 is inserted into the rotation cylindrical hinge 30 and the actuation member 40.

After the content container 50 is inserted into the inner central portion of the compact container body 10, a compact intermediate cover 54 is coupled to an upper portion of the compact container body 10. The content container 50 includes an outer wall 501 and an inner wall 502, the fixing member 53 is fitted into the outer and inner walls 501 and 502, and the content container cap 51 is coupled to the upper portion of the content container 50 by a hinge pin 52.

A button 15 having a locking protrusion 151 is coupled to the compact container body 10, and a hook 25 is formed on the compact container cap 20, so that the locking protrusion 151 of the button 15 and the hook 25 are coupled to each other, so the compact container cap 20 is coupled to the compact container body 10.

As the locking protrusion 151 extending from an upper portion of the button 15 is moved back through the pressing operation of the button 15 by a user, the button 15 is separated from the hook 25 of the compact container cap 20 to open the compact container cap 20.

The compact container cap 20, which covers the upper portion of the compact container body 10, is hinged with the compact container body 10 and opens/closes the compact container body 10.

The content container 50 is provided therein with cosmetics, such as press-type powder or gel-phase foundation, or with an immersion member, such as a sponge, immersed with cosmetic contents.

The fixing member 53 is fitted into the content container 50 so that the impregnation member is not separated from the content container 50.

A mirror 26 may be attached into the compact container cap 20, and the user may open the compact container cap 20 and make up while looking into the mirror 26.

A puff space 511 is formed in an upper portion of the content container cap 51 so that a puff may be provided in the puff space 511.

The rod-shaped cosmetic container 60 is formed therein with a coupling groove 61, and includes a lipstick container, a lip-gloss container, a lip crayon container, a mascara container, and an eyeliner container.

The coupling groove 61 is coupled to the coupling protrusion 43 of the actuation member 40 thereby preventing the rod-shaped cosmetic container 60 from being easily separated from the compact container according to the present invention due to external impact.

Hereinafter, the assembling method and the use state of the compact container having the rod-shaped cosmetic container provided therein according to one embodiment of the present invention will be described.

In order to assemble the compact container having the rod-shaped cosmetic container provided therein according to the present invention, the content container 50 is inserted into the inner central portion of the compact container body 10, and the fixing ember 53 is coupled between the outer and inner walls 501 and 502.

Thereafter, the compact intermediate cover 54 is coupled to the upper portion of the compact container body 10 to prevent the content container 50 from being out of the compact container body 10.

In addition, after assembling the hinge 512 of the content container cap 51 with a hinge block 503 of the content container 50 exposed onto the compact intermediate cover 54, the hinge block 503 and the hinge 512 are coupled to each other by a hinge pin 52.

Then, after interposing the cap cylindrical hinge 21 of the compact container cap 20 between the first cylindrical hinge 11 and the second cylindrical hinge 12 of the compact container body 10, the rotation cylindrical hinge 30 is inserted into the first cylindrical hinge 11, so that the fitting slit 31 of the rotation cylindrical hinge 30 is coupled to the fitting protrusion 211 of the cap cylindrical hinge 21.

The coupling protrusion 33 of the rotation cylindrical hinge 30 is coupled to a mounting groove 212 of the cap cylindrical hinge 21 as shown in FIG. 8 to prevent the rotation cylindrical hinge 30 from being separated from the first cylindrical hinge 11.

The elastic member 34 having an elastic protrusion 341 in the rotation cylindrical hinge 30 elastically presses the inner circumferential surface of the first cylindrical hinge 11, thereby providing a tight rotation feeling as the rotation cylindrical hinge 30 is not loosely rotated in the first cylindrical hinge 11.

Thereafter, the actuation member 40 is inserted into the second cylindrical hinge 12 of the compact container body 10 so that the first protrusion 41 of the actuation member 40 is coupled to the linear recess 121, and the second protrusion 42 is located into the rotation slit 32 of the rotation cylindrical hinge 30 as shown in FIG. 9.

In addition, the rod-shaped cosmetic container 60 is inserted into the rotation cylindrical hinge 30 to complete the assembling work of the compact container having the rod-shaped cosmetic container provided therein according to the present invention.

In this case, since the coupling groove 61 formed in one side of the rod-shaped cosmetic container 60 is coupled to the coupling protrusion 43 of the actuation member 40, when the compact container and the rod-shaped cosmetic container are stored and carried together in a handbag, even if impact is severely applied to the handbag, the rod-shaped cosmetic container 60 is not separated out of the compact container body 10. Accordingly, the rod-shaped cosmetic container 60 and the cosmetic container are stably stored, so that the user needs not to inconveniently look for the rod-shaped cosmetic container 60 in the handbag.

In order to use the rod-shaped cosmetic container 60 provided in the compact container through the above manner, the compact container cap 20 is rotated and open as shown in FIG. 7.

In this case, together with the rotation operation of the compact container cap 20, the rod-shaped cosmetic container 60 is automatically withdrawn from the compact container, so that the user may easily use the rod-shaped cosmetic container 60.

In detail, when the compact container cap 20 is rotated in order to automatically withdraw the rod-shaped cosmetic container 60 from the compact container, the rotation cylindrical hinge 30 is rotated by the rotation of the compact container cap 20 because the fitting protrusion 211 formed on the cap cylindrical hinge 21 of the compact container cap 20 is coupled to the fitting slit 31 of the rotation cylindrical hinge 30.

In this case, as shown in FIG. 10, the second protrusion 42 of the actuation member 40 located in the rotation slit 32 of the rotation cylindrical hinge 30 is moved along the rotation slit 32. In this case, since the first protrusion 41 of the actuation member 40 is located in the linear recess 121 of the second cylindrical hinge 12, the actuation member 40 linearly slides along the linear recess 121 when the second protrusion 42 is moved on the rotation slit 32.

Thereafter, if the user more opens the compact container cap 20, the actuation member 40 is more moved into the second cylindrical hinge 12 of the compact container body 10 as shown in FIG. 11.

The rod-shaped cosmetic container 60 coupled to the coupling protrusion 43 of the actuation member 40 is withdrawn out of the rotation cylindrical hinge 30 by the movement of the actuation member 40 as shown in FIG. 7

The user pulls out the rod-shaped cosmetic container 60 exposed to the outside of the rotation cylindrical hinge 30 for the use of the rod-shaped cosmetic container 60. In this case, as the coupling protrusion 43 of the actuation member 40 is detached from the coupling groove 61 of the rod-shaped cosmetic container 60, the rod-shaped cosmetic container 60 is pulled out.

When the user makes up using the rod-shaped cosmetic container 60, the user looks into the mirror. According to the present invention, when the user opens the compact container cap 20 in order to draw the rod-shaped cosmetic container 60 from the compact container body 10, since the mirror 26 is mounted inside the compact container cap 20 as shown in FIG. 6, the user can conveniently make up using the rod-shaped cosmetic container 60.

After finishing the makeup, the user covers the compact container cap 20 on the compact container body 10 and inserts the rod-shaped cosmetic container 60 into the rotation cylindrical hinge 30 until the coupling groove 61 of the rod-shaped cosmetic container 60 is coupled to the coupling protrusion 43 of the actuation member 40 so that the rod-shaped cosmetic container 60 may be safely stored in the compact container body 10.

Although the compact container having the rod-shaped cosmetic container therein according to one embodiment of the present invention has been described for the illustrative purpose, the present invention is not limited thereto. It is understood that the present invention should not be limited to these exemplary embodiments but various changes and modifications can be made by one ordinary skilled in the art without departing from the subject matter of the present invention within the spirit and scope of the present invention as hereinafter claimed.

BRIEF DESCRIPTION OF REFERENCE NUMERALS

10: Compact container body
11: First cylindrical hinge
12: Second cylindrical hinge
121: linear recess
20: Compact container cap
21: Cap cylindrical hinge
211: Fitting protrusion
30: Rotation cylindrical hinge
31: Fitting slit
32: Rotation slit
33: Coupling protrusion

34: Elastic member
40: Actuation member
41: First protrusion
42: Second protrusion
43: Coupling protrusion
50: Content container
51: Content container cap
53: Fixing member
54: Compact intermediate cover
60: Rod-shaped cosmetic container
61: Coupling groove

The invention claimed is:

1. A compact container having a compact container body hinged with a compact container cap, and a rod-shaped cosmetic container provided therein, the compact container comprising:

the compact container body (10) receiving a content container (50) inserted into an inner central portion thereof and formed at a hinge side thereof with a first cylindrical hinge (11) and a second cylindrical hinge (12);

the compact container cap (20) hinged with an upper portion of the compact container body (10) and having a cap cylindrical hinge (21);

a rotation cylindrical hinge (30) inserted into the first cylindrical hinge (11) and the cap cylindrical hinge (21) to hinge the compact container cap (20) with the compact container body (10);

an actuation member (40) inserted into the second cylindrical hinge (12) and an end portion of the rotation cylindrical hinge (30); and the rod-shaped cosmetic container (60) inserted substantially into the rotation cylindrical hinge (30) and the actuation member (40), wherein the actuation member (40) comprises, on an outer side, a first protrusion (41), wherein the second cylindrical hinge (12) of the compact container body (10) comprises a linear recess (121) extending along an inner side of the hinge side, the first protrusion being configured to slide along the linear recess, wherein, in a closed configuration of the compact container, the first protrusion of the actuation member is in a first position of the linear recess and the rod-shaped cosmetic container is fully received in the compact container, wherein, in an open configuration of the compact container, the first protrusion of the actuation member is in a second position of the linear recess different from the first position and the rod-shaped cosmetic container is withdrawn from the compact container.

2. The compact container of claim 1, wherein the cap cylindrical hinge (21) of the compact container cap (20) has a hollow cylindrical shape, a fitting protrusion (211) protrudes from one side of an inner part of the cap cylindrical hinge (21), and a mounting annular groove (212) is formed in an opposite side of the inner part of the cap cylindrical hinge (21).

3. The compact container of claim 1, wherein the rotation cylindrical hinge (30) has a fitting slit (31) and a rotation slit (32).

4. The compact container of claim 1, wherein the rotation cylindrical hinge (30) is formed on an outer circumferential surface thereof with a coupling protrusion (33) and an elastic member (34).

5. The compact container of claim 4, wherein an elastic protrusion (341) is formed on the elastic member (34).

6. The compact container of claim 1, wherein the actuation member (40) is formed on an outer side thereof with a second protrusion (42) fitted into a rotation slit (32) of the rotation cylindrical hinge (30).

7. The compact container of claim 1, wherein the actuation member (40) is formed on an inner side thereof with a coupling protrusion (43) coupled to a coupling groove (61) of the rod-shaped cosmetic container (60).

8. The compact container of claim 1, wherein the rod-shaped cosmetic container (60) is formed therein with a coupling groove (61).

* * * * *